US008900782B2

(12) United States Patent
Anazawa et al.

(10) Patent No.: US 8,900,782 B2
(45) Date of Patent: Dec. 2, 2014

(54) ELECTROPHOTOGRAPHIC PHOTORECEPTOR, PROCESS CARTRIDGE, IMAGE FORMING APPARATUS, AND IMAGE FORMING METHOD

(75) Inventors: Kazunori Anazawa, Kanagawa (JP); Tomoko Miyahara, Kanagawa (JP); Kaoru Torikoshi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 39 days.

(21) Appl. No.: 13/408,455

(22) Filed: Feb. 29, 2012

(65) Prior Publication Data

US 2013/0040233 A1 Feb. 14, 2013

(30) Foreign Application Priority Data

Aug. 10, 2011 (JP) ..... 2011-175266

(51) Int. Cl.

| | |
|---|---|
| ***G03G 5/14*** | (2006.01) |
| ***G03G 21/18*** | (2006.01) |
| ***G03G 13/22*** | (2006.01) |
| ***G03G 15/02*** | (2006.01) |
| ***G03G 5/04*** | (2006.01) |

(52) U.S. Cl.

CPC ..... *G03G 5/04* (2013.01); *G03G 21/18* (2013.01); *G03G 13/22* (2013.01); *G03G 15/02* (2013.01)

USPC ..... 430/60; 430/125.3

(58) Field of Classification Search

CPC ..... G03G 15/02; G03G 21/18; G03G 5/04

USPC ..... 430/56, 60, 62, 63, 125.3

See application file for complete search history.

(56) References Cited

U.S. PATENT DOCUMENTS

| | | | | |
|---|---|---|---|---|
| 5,298,617 | A | 3/1994 | Nukada et al. | |
| 6,169,246 | B1 * | 1/2001 | Wu et al. | 136/265 |
| 2007/0049677 | A1 * | 3/2007 | Wu et al. | 524/430 |
| 2009/0297217 | A1 * | 12/2009 | Iwanaga et al. | 399/111 |
| 2010/0015539 | A1 * | 1/2010 | Qi et al. | 430/58.05 |
| 2010/0248105 | A1 * | 9/2010 | Nukada et al. | 430/66 |
| 2011/0104599 | A1 * | 5/2011 | Nagasaka et al. | 430/56 |

FOREIGN PATENT DOCUMENTS

| | | |
|---|---|---|
| JP | A-4-189873 | 7/1992 |
| JP | A-5-043823 | 2/1993 |
| JP | A-5 098181 | 4/1993 |
| JP | A-5-140472 | 6/1993 |
| JP | A-5-140473 | 6/1993 |
| JP | A-5-263007 | 10/1993 |
| JP | A-5-279591 | 10/1993 |
| JP | A-8-176293 | 7/1996 |
| JP | A-8-208820 | 8/1996 |
| JP | A-2007-322996 | 12/2007 |

* cited by examiner

*Primary Examiner* — Mark F Huff
*Assistant Examiner* — Rashid Alam
(74) *Attorney, Agent, or Firm* — Oliff PLC

(57) ABSTRACT

An electrophotographic photoreceptor includes a substrate; an undercoat layer provided on the substrate and containing a tin-zinc complex oxide powder having a volume resistivity of about $2\times10^9$ Ω·cm or less; and a photosensitive layer provided on the undercoat layer.

14 Claims, 3 Drawing Sheets

ELECTROPHOTOGRAPHIC PHOTORECEPTOR, PROCESS CARTRIDGE, IMAGE FORMING APPARATUS, AND IMAGE FORMING METHOD

CROSS-REFERENCE TO RELATED APPLICATIONS

This application is based on and claims priority under USC 119 from Japanese Patent Application No. 2011-175266, filed Aug. 10, 2011.

BACKGROUND

1. Technical Field

The present invention relates to an electrophotographic photoreceptor, a process cartridge, an image forming apparatus, and an image forming method.

2. Related Art

As electrophotographic photoreceptors used for an electrophotographic image forming apparatus, a photoreceptor in which a photosensitive layer containing a photoconductive material is formed on a substrate having conductivity is known. An undercoat layer is provided between the substrate and the photosensitive layer.

Here, in the related art, an undercoat layer containing conductive metal oxide particles is attempted.

SUMMARY

According to an aspect of the invention, there is provided an electrophotographic photoreceptor including a substrate; an undercoat layer provided on the substrate and containing a tin-zinc complex oxide powder having a volume resistivity of about $2\times10^9$ Ω·cm or less; and a photosensitive layer provided on the undercoat layer.

BRIEF DESCRIPTION OF THE DRAWINGS

Exemplary embodiments of the present invention will be described in detail based on the following figures, wherein.

DETAILED DESCRIPTION

Figure 1:
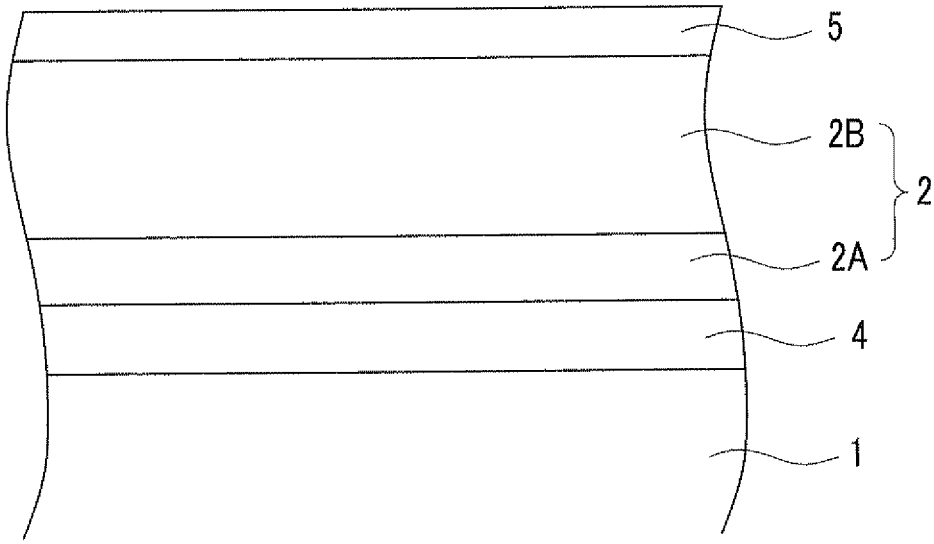
FIG. 1 is a schematic fragmentary cross-sectional view showing an electrophotographic photoreceptor related to a first aspect of the present exemplary embodiment.

Exemplary embodiments of the invention will be described below in detail.

<Electrophotographic Photoreceptor>

An electrophotographic photoreceptor (which hereinafter, may simply be referred to as a "photoreceptor") related to the present exemplary embodiment has a substrate, an undercoat layer containing a tin-zinc complex oxide powder having a volume resistivity of $2\times10^9$ Ω·cm or less (or about $2\times10^9$ Ω·cm or less), and a photosensitive layer in this order.

In the related art, the undercoat layer is made to contain zinc oxide, titanium oxide, tin oxide, or the like which are used as conductive metal oxide particles. However, when titanium oxide is made into particles and used, there is a situation where dispersibility is not easily obtained in a coating liquid for forming the undercoat layer, and unevenness of the titanium oxide occurs in the undercoat layer. Accordingly, a sufficient potential difference (contrast in potential) is not obtained between the charging potential and residual potential of the photoreceptor, and in a resulting image, fogging (a phenomenon in which toner adheres to a non-image region of a recording medium, and an image defect occurs) occurs. Additionally, even when the zinc oxide is used, fogging may occur similarly to the titanium oxide.

On the other hand, when particles of tin oxide, and/or tin oxide particles doped with antimony oxide, or barium sulfate particles coated with tin oxide is used, there is a situation where the electric resistance of an obtained undercoat layer is low compared to a case where the titanium oxide and/or the zinc oxide is used. Here, when the photoreceptor is repeatedly used in an image forming apparatus, a conductive material peeled from other members penetrates into the surface of the photoreceptor. This conductive material may function as a trigger that generates an abnormal current in the photoreceptor when being charged by a charging device, whereby charges of the photoreceptor may leak. When the electric resistance of the undercoat layer is low as mentioned above, leak resistance against the leak of the charges of the photoreceptor may not be easily obtained, and as a result, an image quality defect caused by a leak current may appear on a recording medium.

In contrast, in the photoreceptor related to the present exemplary embodiment, the tin-zinc complex oxide powder having a volume resistivity of $2\times10^9$ Ω·cm or less as the conductive particles to be contained in the undercoat layer is used. Therefore, occurrence of fogging and occurrence of an image quality defect caused by a leak current are suppressed. Although the mechanism is not necessarily clear, this is believed to be because the dispersibility in the coating liquid for the undercoat layer is excellent and the unevenness in the undercoat layer is suppressed, compared to the case where the titanium oxide and/or the zinc oxide is used. Additionally, this is believed to be because the electric resistance of the undercoat layer may be made high compared to the case where the tin oxide is used.

Next, the configuration of the photoreceptor related to the present exemplary embodiment will be described.

—Configuration of Photoreceptor—

The photoreceptor related to the present exemplary embodiment has a substrate, an undercoat layer, and a photosensitive layer in this order. The photosensitive layer may be a separation function type photosensitive layer including a charge transport layer and a charge generation layer, or may be an integral function type photosensitive layer having a charge transport function and a charge generation function together.

Although the configuration of the photoreceptor related to the present exemplary embodiment will be described below with reference to FIGS. 1 and 2, the present exemplary embodiment is not limited to FIGS. 1 and 2.

FIG. 1 is a schematic cross-sectional view showing an example of the layer configuration of the photoreceptor related to the present exemplary embodiment. In FIG. 1, reference numeral 1 designates a substrate, reference numeral 2 designates a photosensitive layer, reference numeral 2A designates a charge generation layer, reference numeral 2B designates a charge transport layer, reference numeral 4 designates an undercoat layer, and reference numeral 5 designates a protective layer 5.

The photoreceptor shown in FIG. 1 has a layer configuration in which the undercoat layer 4, the charge generation layer 2A, the charge transport layer 2B, and the protective layer 5 are laminated in this order on the substrate 1, and the photosensitive layer 2 is composed of two layers of the charge generation layer 2A and the charge transport layer 2B (first aspect).

Figure 2:
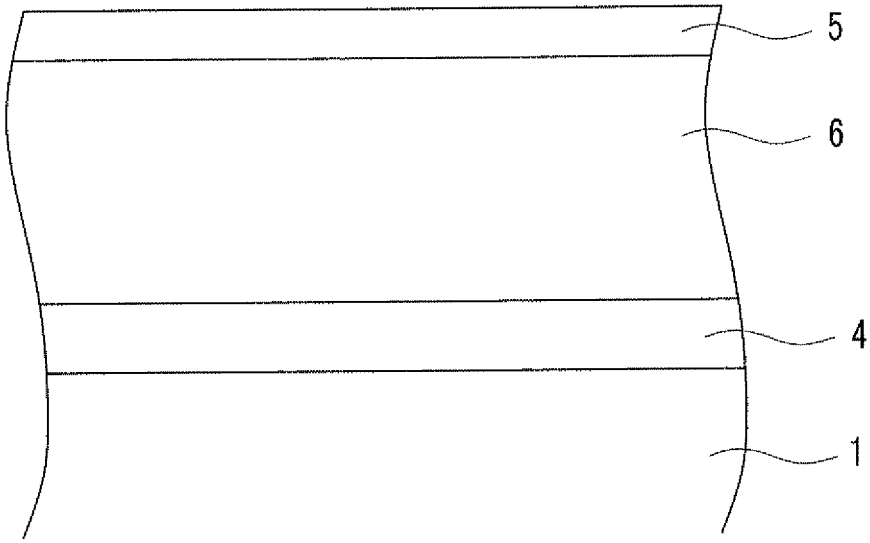
FIG. 2 is a schematic fragmentary cross-sectional view showing an electrophotographic photoreceptor related to a second aspect of the present exemplary embodiment.

FIG. 2 is a schematic cross-sectional view showing another example of the layer configuration of the photoreceptor related to the present exemplary embodiment. In FIG. 2, reference numeral 6 represents an integral function type photosensitive layer, and the others are the same as those shown in FIG. 1.

The photoreceptor shown in FIG. 2 has a layer configuration in which the undercoat layer 4, the photosensitive layer 6, and the protective layer 5 are laminated in this order on the substrate 1, and the photosensitive layer 6 is a layer in which the charge generation layer 2A and the charge transport layer 2B shown in FIG. 1 are integrated (second aspect).

In addition, the photoreceptors of the first aspect and the second aspect may be an aspect that does not have the protective layer 5.

The first aspect will be described below in detail, taking the first aspect as an example of the photoreceptor related to the present exemplary embodiment.

(First Aspect)

The photoreceptor related to the first aspect, as shown in FIG. 1, has a layer configuration in which the undercoat layer 4, the charge generation layer 2A, the charge transport layer 2B, and the protective layer 5 are laminated in this order on the substrate 1.

—Substrate

A substrate having conductivity is used as the substrate 1. Examples of the substrate 1 include metal plates, metal drums, and metal belts containing metals such as aluminum, copper, zinc, stainless steel, chromium, nickel, molybdenum, vanadium, indium, gold, and platinum or alloys thereof; and paper, plastic films, and belts on which a conductive polymer, a conductive compound such as indium oxide, a metal such as aluminum, palladium, or gold, or an alloy is applied, vapor-deposited, or laminated. Here, the "conductivity" means that the volume resistivity is less than $10^{13}$ Ω·cm.

In a case where the photoreceptor related to the first aspect is used for a laser beam printer, the surface of the substrate 1 is preferably roughened such that the central line average roughness Ra is from 0.04 μm to 0.5 μm. Here, when incoherent light is used for a light source, it is not necessary to perform surface-roughening particularly.

As a surface-roughening method, wet honing performed by making abrasive agent be suspended in water and blowing the suspension against a support, or centerless grinding that continuously performs grinding after a rotating grind stone is brought into contact with a support, anodizing, or the like is preferable.

Additionally, a method for dispersing conductive or semi-conductive powder in resin without surface-roughening the surface of the substrate 1, forming a layer on the surface of a support, and performing surface-roughening using particles dispersed in the layer is also preferable as another surface-roughening method.

Here, the surface-roughening processing by anodic oxidation means that an oxide film is formed on the surface of aluminum by using aluminum as an anode and performing anodizing in an electrolyte solution. The electrolyte solution includes a sulfuric acid solution, an oxalic acid solution, and the like. However, since a porous anodized film formed by anodic oxidation is chemically active in such a state, it is preferable to perform sealing processing that closes micropores of the anodized film with the volume expansion caused by a hydration reaction in steam under pressure or boiling water (metal salts such as nickel may be added), and changes the anodized film into a more stable hydrated oxide. The thickness of the anodized film is preferably from 0.3 μm to 15 μm.

Additionally, treatment using an acidic aqueous solution or boehmite treatment may be performed on the substrate 1.

Treatment using an acidic treatment liquid containing phosphoric acid, chromic acid, and fluoric acid is carried out as follows. First, the acidic treatment liquid is prepared. As the blending ratios of phosphoric acid, chromic acid, and fluoric acid in the acidic treatment liquid, the blending ratio of the phosphoric acid is within a range of from 10% by weight to 11% by weight, the blending ratio of the chromic acid is within a range of from 3% by weight to 5% by weight, the blending ratio of the fluoric acid is within a range of from 0.5% by weight to 2% by weight, and the total concentration of these acids is preferably within a range of from 13.5% by weight to 18% by weight. The treatment temperature is preferably from 42° C. to 48° C. The thickness of a coating is preferably from 0.3 μm to 15 μm.

The Boehmite treatment is performed by dipping in pure water of from 90° C. to 100° C. for 5 minutes to 60 minutes or by bringing into heating steam of from 90° C. to 120° C. for 5 minutes to 60 minutes. The thickness of a coating is preferably from 0.1 μm to 5 μm. This may be anodized using an electrolyte solution having lower coating solubility compared to other kinds such as adipic acid, boric acid, borate, phosphate, phthalate, maleate, benzoate, tartrate, and citrate.

—Undercoat Layer

The undercoat layer 4 contains, for example, a tin-zinc complex oxide powder having a volume resistivity of $2\times10^9$ Ω·cm or less, and is constituted as, for example, a layer having the tin-zinc complex oxide powder dispersed in a binder resin.

—Particle Size of Tin-Zinc Complex Oxide Powder—

In addition, the "powder" means that state in which a solid becomes particles and a number of the particles aggregate.

The average particle size (volume average particle size) of the tin-zinc complex oxide powder is preferably within a range of from 20 nm to 200 nm (or from about 20 nm to about 200 nm), and more preferably within a range of from 20 nm to 100 nm.

The average particle size is a value obtained by measuring volume average particle size (d50 average particle size) using a laser diffraction/scattering particle size distribution measuring device (LA-700 made by Horiba, Ltd.). The numerical values described in the present specification are measured by this method.

—Making Resistance of Tin-Zinc Complex Oxide Powder Low—

The tin-zinc complex oxide powder normally has a high specific resistance. Although a method for making the resistance of the tin-zinc complex oxide powder low to such a degree that sufficient electric resistance may be imparted is not particularly limited, a method for performing heat treatment under reduced pressure is appropriately used. The resistance of the tin-zinc complex oxide powder is made low by performing heat treatment under reduced pressure, and a tin-zinc complex oxide powder having a volume resistivity in an obtained range (that is, $2\times10^9$ Ω·cm or less) is obtained.

—Volume Resistivity—

The volume resistivity of the tin-zinc complex oxide powder is more preferably equal to or less than $10^6$ Ω·cm (or equal to or less than about $10^6$ Ω·cm), and particularly preferably equal to or less than $10^4$ Ω·cm.

In addition, as the volume resistivity of the tin-zinc complex oxide powder, the volume resistivity is measured by using a powder resistance measuring unit (MCP-PD51) made by Mitsubishi Chemical Analytech Co., Ltd. and setting measuring conditions as follows. In addition, the measurement is performed two or more times, and the average value thereof is adopted as the volume resistivity.

(Measuring Conditions)

Applied voltage limiter: 90 V

Probe used: 4-probe probe (electrode interval: 3.0 mm, electrode radius: 0.7 mm, sample radius: 10.0 mm)

Load: 4.00 kN, Pressure: 12.7 MPa

The numerical values described in the present specification are measured by the above method.

In addition, the operation of separating the tin-zinc complex oxide powder from the undercoat layer is performed prior to measuring the volume resistivity of the tin-zinc complex oxide powder contained in the undercoat layer. As a specific separation method, the undercoat layer may be dissolved with a solvent, and a solution and the powder may be separated by centrifugation, filtering, or the like.

The solvent is arbitrarily selected from publicly known organic solvents such as alcohol, aromatic hydrocarbon, halogenated hydrocarbon, ketone, ketone alcohol, ether, and ester organic solvents. For example, ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene, are used. Any solvent may be used as long as the solvent may dissolve a binder resin. Moreover, a sample for measuring volume resistivity is obtained by drying the separated powder to a temperature higher than the boiling point of the solvent used.

—Method for Producing Tin-Zinc Complex Oxide Powder—

Specific examples of the tin-zinc complex oxide powder include, but are not limited to, $ZnSnO_3$, $Zn_2SnO_4$, and the like.

Additionally, methods of controlling the volume resistivity of the tin-zinc complex oxide powder to be within a range of $2\times10$ Ω·cm or less as mentioned above include, but are not limited to, a method for performing heat treatment under reduced pressure as mentioned above. More specifically, it is preferable to heat-treat the tin-zinc complex oxide powder at a temperature of from 450° C. to 900° C. (or from about 450° C. to about 900° C.) under reduced pressure. Further, a range of from 450° C. to 600° C. is more preferable, and a range of from 500° C. to 600° C. is particularly preferable.

As the range of the reduced pressure, the degree of vacuum is preferably from 10 Pa to 3 kPa (or from about 10 Pa to about 3 kPa), more preferably from 180 Pa to 3 kPa, and particularly preferably from 670 Pa to 3 kPa.

In addition, the degree of vacuum in heat treatment is measured by attaching a crystal ion gauge to a port of a vacuum heat treatment furnace and using a degree-of-vacuum indicator connected thereto. The numerical values described in the present specification are measured by this method.

The heat-treatment time is preferably 0.5 hour or more, and more preferably 2 hours or more.

Additionally, the tin-zinc complex oxide powder is preferably an amorphous material.

As the amorphous material is used as the tin-zinc complex oxide powder, the resistance may be easily made low, a favorable crushed characteristic is provided, particle size reduction may be easily performed, dispersion in the undercoat layer may be performed more favorably, and the unevenness of the tin-zinc complex oxide powder is further suppressed.

In addition, whether or not the tin-zinc complex oxide powder is an amorphous material is confirmed by X-ray diffraction measurement.

Additionally, methods of controlling the tin-zinc complex oxide powder to be an amorphous material include a method for setting the temperature in drying and heat treatment to a crystallization temperature or lower, or the like.

The content of the tin-zinc complex oxide powder in the undercoat layer is preferably from 10% by weight to 95% by weight (or from about 10% by weight to about 95% by weight), and more preferably from 25% by weight to 85% by weight.

<Other Configurations of Undercoat Layer>

The undercoat layer 4 may be made to contain an acceptor compound in addition to the tin-zinc complex oxide powder. Any acceptor compound may be used, but the acceptor compound is preferably an electron transport material such as quinone compounds such as chloranil and bromanil, tetracyanoquinodimethane compounds, fluorene compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone compounds, thiophene compounds, and diphenoquinone compounds such as 3,3',5,5'-tetra-t-butyldiphenoquinone. Particularly, compounds having an anthraquinone structure are preferred. Moreover, acceptor compounds having an anthraquinone structure include hydroxyanthraquinone compounds, aminoanthraquinone compounds, and aminohydroxyanthraquinone compounds are preferably used. Specific examples thereof include anthraquinone, alizarin, quinizarin, anthrarufin, and purpurin.

The content of these acceptor compounds may be arbitrarily set, but is preferably from 0.01% by weight to 20% by weight with respect to the amount of the tin-zinc complex oxide powder. The content of the acceptor compounds is more preferably from 0.05% by weight to 10% by weight.

The acceptor compound may be added only when the undercoat layer 4 is applied, or may be made to adhere to the surface of the tin-zinc complex oxide powder in advance. Methods of imparting the acceptor compound to the surfaces of the tin-zinc complex oxide powder include a dry method or a wet method.

When the surface treatment is performed by a dry method, the acceptor compound as is or dissolved in an organic solvent is dropped or sprayed together with dry air or nitrogen gas while the tin-zinc complex oxide powder is stirred by a mixer or the like having a large shear force. The addition or spraying is preferably performed at a temperature equal to or lower than the boiling point of the solvent. After the addition or spraying, baking may be further performed at a temperature of 100° C. or higher. The temperature and time of the baking is set within an arbitrary range.

The wet method is performed as follows. The tin-zinc complex oxide powder is stirred in a solvent and dispersed using ultrasonic waves, a sand mill, an attritor, a ball mill, or the like. The acceptor compound is added, the resulting mixture is stirred or dispersed, and then the solvent is removed. The solvent removal method is performed by filtration or distillation. After the removal of the solvent, baking may be further performed at a temperature of 100° C. or higher. The temperature and time of the baking is set within an arbitrary range. In the wet method, moisture contained in the tin-zinc complex oxide powder may be removed before the surface treating agent is added. For example, the moisture may be removed by stirring and heating the tin-zinc complex oxide powder in a solvent used for surface treatment or by using an azeotropic solvent.

Additionally, the tin-zinc complex oxide powder may be surface-treated before the acceptor compound is added. The surface treating agent is selected from any publicly known materials. Examples of the surface treating agent include silane coupling agents, titanate coupling agents, aluminum coupling agents, and surfactants. Particularly, silane coupling agents are preferably used. Moreover, silane coupling agents having an amino group are also more preferably used.

Any silane coupling agent having an amino group may be used. Specific examples of the silane coupling agent include γ-aminopropyltriethoxysilane, N-β-(aminoethyl)-γ-aminopropyltrimethoxysilane, N-β-(aminoethyl)-γ-aminopropylmethylmethoxysilane, and N,N-bis(β-hydroxyethyl)-γ-aminopropyltriethoxysilane. However, the silane coupling agent is not limited thereto.

Additionally, the silane coupling agents may be used in a mixture of two or more kinds thereof. Examples of the silane coupling agent that may be used together with the silane coupling agent having an amino group include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane. However, the silane coupling agent is not limited thereto.

Any publicly known surface-treating method may be used. For example, a wet method or a dry method may be preferably used. Additionally, the addition of the acceptor compound and the surface-treatment with a coupling agent and the like may be performed simultaneously.

The amount of the silane coupling agent to the tin-zinc complex oxide powder in the undercoat layer 4 is arbitrarily set, but is preferably from 0.5% by weight to 10% by weight with respect to the tin-zinc complex oxide powder.

The binder resin contained in the undercoat layer 4 may be any binder resin used for publicly known undercoat layers. Examples of the binder resin include publicly known polymer resin compounds such as acetal resin, e.g., polyvinyl butyral, polyvinyl alcohol resin, casein, polyamide resin, cellulose resin, gelatin, polyurethane resin, polyester resin, methacrylate resin, acrylate resin, polyvinyl chloride resin, polyvinyl acetate resin, vinyl chloride-vinyl acetate-maleic anhydride resin, silicone resin, silicone-alkyd resin, phenol resin, phenol-formaldehyde resin, melamine resin, and urethane resin; charge transport resins having a charge transport group; and conductive resins such as polyaniline. Among these, resins insoluble in a coating solvent of the upper layer are preferably used, and phenol resins, phenol-formaldehyde resins, melamine resins, urethane resins, epoxy resins, and the like are particularly preferably used. When two or more of these materials are used in combination, the mixing ratio is set if needed.

In addition, the ratio of the acceptor compound to the binder resin in the coating liquid for forming an undercoat layer or the ratio of the tin-zinc complex oxide powder to the binder resin is freely set.

Various additives may be used in the undercoat layer 4. Publicly known materials are used as the additives, and examples of the additives include polycyclic-condensed type electron transport pigments, azo type electron transport pigments, zirconium chelate compounds, titanium chelate compounds, aluminum chelate compounds, titanium alkoxide compounds, organic titanium compounds, and silane coupling agents. Although a silane coupling agent is used for surface treatment of the metal oxide, the silane coupling agent may also be added as an additive to the coating liquid. Examples of the silane coupling agent used herein specifically include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl)titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxy titanium stearate.

Examples of the aluminum chelate compounds include aluminum isopropylate, monobutoxy aluminum diisopropylate, aluminum butyrate, ethyl acetoacetate aluminum diisopropylate, and aluminum tris(ethyl acetoacetate).

These compounds may be used singly or as a mixture or a polycondensate of two or more compounds.

The solvent for preparing the coating liquid for forming the undercoat layer is selected from publicly known organic solvents such as alcohol, aromatic hydrocarbon, halogenated hydrocarbon, ketone, ketone alcohol, ether, and ester organic solvents. As the solvent, for example, ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene are used.

These solvents used for dispersion may be used singly or in a mixture of two or more kinds thereof. When the solvents are used in a mixed manner, any solvent may be used as long as the solvent dissolves a binder resin as a mixed solvent.

For the dispersion method, a publicly known method that uses a roll mill, a ball mill, a vibrating ball mill, an attritor, a sand mill, a colloid mill, or a paint shaker is employed. Moreover, examples of the coating method used when the undercoat layer 4 is provided include ordinary methods such as a blade coating method, a wire bar coating method, a spray coating method, a dip coating method, a bead coating method, an air knife coating method, and a curtain coating method.

The undercoat layer 4 is formed on the substrate 1 using the coating liquid for forming an undercoat layer obtained in this way.

Additionally, the Vickers hardness of the undercoat layer 4 is preferably 35 or more.

Moreover, the thickness of the undercoat layer 4 may be arbitrarily set, but is preferably 15 μm or more and more preferably from 15 μm to 50 μm.

Additionally, the surface roughness (ten-point average roughness) of the undercoat layer 4 is adjusted to from ¼n (n is a refractive index of the upper layer) to ½λ of the exposure laser wavelength λ to prevent moire patterns. Particles such as resin particles may be added to the undercoat layer to adjust the surface roughness. As the resin particles, silicone resin particles, cross-linked polymethyl methacrylate resin particles, and the like are used.

Additionally, the undercoat layer may be polished to adjust the surface roughness. As the polishing method, buff polishing, sand blasting, wet horning, and grinding and the like are used.

The applied coating liquid is dried to obtain an undercoat layer. Drying is normally performed at a temperature at which the solvent is evaporated and a film is formed.

—Charge Generation Layer

The charge generation layer 2A is preferably a layer that contains at least a charge generation material and a binder resin.

Examples of the charge generation material include azo pigments such as bisazo and trisazo, condensed polycyclic aromatic pigments such as dibromoanthanthrone, perylene pigments, pyrrolopyrrole pigments, phthalocyanine pigments, zinc oxide, and trigonal selenium. Among these, metal or metal-free phthalocyanine pigments are preferred for the near infrared laser exposure. Particularly, hydroxygallium phthalocyanine disclosed in JP-A-5-263007 and JP-A-5-279591, chlorogallium phthalocyanine disclosed in JP-A-5-98181, dichlorotin phthalocyanine disclosed in JP-A-5-140472 and JP-A-5-140473, and titanyl phthalocyanine disclosed in JP-A-4-189873 and JP-A-5-43823 are more preferable. For the near ultraviolet laser exposure, condensed polycyclic aromatic pigments such as dibromoanthanthrone, thioindigo pigments, porphyrazine compounds, zinc oxide, and trigonal selenium are more preferable. When a light source having an exposure wavelength of from 380 nm to 500 nm is used, an inorganic pigment may be used preferably as the charge generation material. When a light source having an exposure wavelength of from 700 nm to 800 nm is used, a metal or metal-free phthalocyanine pigment may be used preferably as the charge generation material.

A hydroxygallium phthalocyanine pigment having a maximum peak wavelength within a range of from 810 nm to 839 nm, which is measured by spectrometry in a wavelength region of from 600 nm to 900 nm, may be preferably used as the charge generation material. The hydroxygallium phthalocyanine pigment is different from a related-art V-type hydroxygallium phthalocyanine pigment. The maximum peak wavelength thereof measured by spectrometry is shifted to shorter wavelengths compared with the related-art V-type hydroxygallium phthalocyanine pigment.

Additionally, the hydroxygallium phthalocyanine pigment having a maximum peak wavelength within a range of from 810 nm to 839 nm preferably has an average particle size within a specific range and has a BET specific surface area within a specific range. Specifically, the average particle size is preferably 0.20 μm or less and more preferably from 0.01 μm to 0.15 μm. The BET specific surface area is preferably 45 $m^2/g$ or more, and more preferably 50 $m^2/g$ or more, and particularly preferably from 55 $m^2/g$ to 120 $m^2/g$. The average particle size is a volume average particle size (d50 average particle size) measured using a laser diffraction/scattering particle size distribution measuring device (LA-700 made by HORIBA, Ltd.). Additionally, the BET specific surface area is a value measured by a nitrogen substitution method using a BET specific surface area measuring instrument (FlowSorb II2300 made by Shimadzu Corporation).

Additionally, the maximum particle size (the maximum value of primary particle size) of the hydroxygallium phthalocyanine pigment is preferably 1.2 μm or less, more preferably 1.0 μm or less, and particularly preferably 0.3 μm or less.

Moreover, the hydroxygallium phthalocyanine pigment preferably has an average particle size of 0.2 μm or less, a maximum particle size of 1.2 μm or less, and a specific surface area value of 45 $m^2/g$ or more.

Additionally, the hydroxygallium phthalocyanine pigment preferably has diffraction peaks at Bragg angles (2θ±0.2°) of 7.5°, 9.9°, 12.5°, 16.3°, 18.6°, 25.1°, and 28.3° in the X-ray diffraction spectrum measured using CuKα characteristic X-rays.

Additionally, the rate of decline of the weight of the hydroxygallium phthalocyanine pigment measured when the temperature is increased from 25° C. to 400° C. is preferably from 2.0% to 4.0% and more preferably from 2.5% to 3.8%.

The binder resin used for the charge generation layer 2A is selected from a wide range of insulating resins, and may be selected from organic photoconductive polymers such as poly-N-vinylcarbazole, polyvinyl anthracene, polyvinyl pyrene, and polysilane. Preferable examples of the binder resin include polyvinyl butyral resin, polyarylate resin (such as polycondensate of a bisphenol and an aromatic divalent carboxylic acid), polycarbonate resin, polyester resin, phenoxy resin, vinyl chloride-vinyl acetate copolymer, polyamide resin, acrylate resin, polyacrylamide resin, polyvinylpyridine resin, cellulose resin, urethane resin, epoxy resin, casein, polyvinyl alcohol resin, and polyvinylpyrrolidone resin. These binder resins may be used singly or in a mixture of two or more kinds thereof. The blending ratio of the charge generation material to the binder resin may be within a range of from 10:1 to 1:10 by weight ratio. Here, the "insulating" means that the volume resistivity is $10^{13}$ Ω·cm or more.

The charge generation layer 2A is formed, for example, by using a coating liquid prepared by dispersing the charge generation material and the binder resin in a solvent.

Examples of the solvent used for dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used singly or in a mixture of two or more kinds thereof.

Additionally, examples of a method for dispersing the charge generation material and the binder resin in the solvent include ordinary methods such as a ball mill dispersion method, an attritor dispersion method, and a sand mill dispersion method. Moreover, in this dispersion, it is effective that the average particle size of the charge generation material be adjusted to be 0.5 μm or less, preferably 0.3 μm or less, and more preferably 0.15 μm or less.

Additionally, when the charge generation layer 2A is formed, ordinary methods such as a blade coating method, a Meyer bar coating method, a spray coating method, a dip coating method, a bead coating method, an air knife coating method, and a curtain coating method are used.

The thickness of the charge generation layer 2A obtained in this way is preferably from 0.1 μm to 5.0 μm and more preferably from 0.2 μm to 2.0 μm.

—Charge Transport Layer

The charge transport layer 2B is preferably a layer containing at least the charge transport material and the binder resin or is a layer containing a polymeric charge transport material.

Examples of the charge transport material include electron transport compounds such as quinone compounds, e.g., p-benzoquinone, chloranil, bromanil, and anthraquinone; tetracyanoquinodimethane compounds, fluorenone compounds, e.g., 2,4,7-trinitrofluorenone, xanthone compounds, benzophenone compounds, cyanovinyl compounds, and ethylene compounds; and hole transport compounds such as triarylamine compounds, benzidine compounds, arylalkane compounds, aryl-substituted ethylene compounds, stilbene compounds, anthracene compounds, and hydrazone compounds. These charge transport materials may be used singly or in a mixture of two or more kinds thereof, but are limited thereto.

The charge transport material is preferably a triaryl amine derivative represented by the following Formula (a-1) and a benzidine derivative represented by the following Formula (a-2) from the viewpoint of charge mobility.

(a-1)

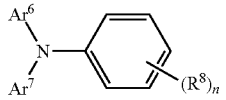

In Formula (a-1), $R^8$ represents a hydrogen atom or a methyl group. n represents 1 or 2. $Ar^6$ and $Ar^7$ each independently represent a substituted or unsubstituted aryl group, $—C_6H_4—C(R^9)=C(R^{10})(R^{11})$, or $—C_6H_4—CH=CH—CH=C(R^{12})(R^{13})$, wherein $R^9$ to $R^{13}$ each independently represent a hydrogen atom, a substituted or unsubstituted alkyl group, or a substituted or unsubstituted aryl group. The substituent is a halogen atom, an alkyl group having from 1 to 5 carbon atoms, an alkoxy group having from 1 to 5 carbon atoms, or an amino group having an alkyl group having from 1 to 3 carbon atoms as a substituent.

(a-2)

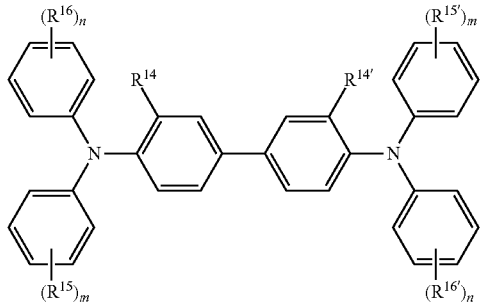

In Formula (a-2), $R^{14}$ and $R^{14'}$ may be the same or different from each other, and each independently represent a hydrogen atom, a halogen atom, an alkyl group having from 1 to 5 carbon atoms, or an alkoxy group having from 1 to 5 carbon atoms. $R^{15}$, $R^{15'}$, $R^{16}$, and $R^{16'}$ may be the same or different from each other, and each independently represent a hydrogen atom, a halogen atom, an alkyl group having from 1 to 5 carbon atoms, an alkoxy group having from 1 to 5 carbon atoms, an amino group having an alkyl group having from 1 to 2 carbon atoms as a substituent, a substituted or unsubstituted aryl group, $—C(R^{17})=C(R^{18})(R^{19})$, or $—CH=CH—CH=C(R^{20})(R^{21})$, wherein $R^{17}$ to $R^{21}$ each independently represent a hydrogen atom, a substituted or unsubstituted alkyl group, or a substituted or unsubstituted aryl group. m and n each independently represent an integer of from 0 to 2.

Here, among the triarylamine derivatives represented by Formula (a-1) and the benzidine derivatives represented by Formula (a-2), triarylamine derivatives having $—C_6H_4—CH=CH—CH=C(R^{12})(R^{13})$ and benzidine derivatives having $—CH=CH—CH=C(R^{20})(R^{21})$ are particularly preferable.

Examples of the binder resins used for charge transport layer 2B include polycarbonate resin, polyester resin, polyarylate resin, methacrylate resin, acrylate resin, polyvinyl chloride resin, polyvinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-alkyd resin, poly-N-vinylcarbazole, and polysilane. Additionally, as described above, polymeric charge transport materials such as polyester-based polymeric charge transport materials disclosed in JP-A-8-176293 and JP-A-8-208820 may be used as the binder resin. These binder resins may be used singly or in a mixture of two or more kinds thereof. The blending ratio between the charge transport material and the binder resin is preferably from 10:1 to 1:5 by weight ratio.

Although the binder resin is not particularly limited, the binder resin preferably includes at least one selected from a polycarbonate resin having a viscosity-average molecular weight of from 50,000 to 80,000 and a polyarylate resin having a viscosity-average molecular weight of from 50,000 to 80,000.

Additionally, a polymeric charge transport material may also be used as the charge transport material. As the polymeric charge transport material, publicly known materials having charge transport properties such as poly-N-vinyl carbazole and polysilane may be used. Particularly, polyester polymeric charge transport materials disclosed in JP-A-8-176293 and JP-A-8-208820 are particularly preferable. The charge transport polymer material forms a film by itself, but may also be mixed with the aforementioned binder resin to form a film.

The charge transport layer 2B may be formed using, for example, a coating liquid for forming a charge transport layer containing the above constituent materials. Examples of the solvent used for the coating liquid for forming the charge transport layer include ordinary organic solvents, e.g., aromatic hydrocarbons such as benzene, toluene, xylene and chlorobenzene; ketones such as acetone and 2-butanone; aliphatic hydrocarbon halides such as methylene chloride, chloroform and ethylene chloride; and cyclic or straight-chain ethers such as tetrahydrofuran and ethyl ether. These solvents may be used singly or in a mixture of two or more kinds thereof. Additionally, as the method for dispersing the constituent materials, publicly known methods are used.

As the method for applying the coating liquid for forming the charge transport layer onto the charge generation layer 2A, ordinary methods such as a blade coating method, a Meyer bar coating method, a spray coating method, a dip coating method, a bead coating method, an air knife coating method, and a curtain coating method are used.

The film thickness of the charge transport layer 2B may be preferably from 5 μm to 50 μm and more preferably from 10 μm to 30 μm.

—Protective Layer

The protective layer 5 is not particularly limited, but preferably contains the following components, for example.

(A) A cross-linked component of a compound having a guanamine structure or a melamine structure, and a compound containing a charge transport material (hereinafter simply referred to as "specific charge transport material") having at least one substituent group selected from —OH, —$OCH_3$, —$NH_2$, —SH, and —COOH.

(B) Fluoro-Resin Particles (A) A compound having a guanamine structure or a melamine structure, and a compound containing a charge transport material ("specific charge transport material") having at least one substituent group selected from —OH, —$OCH_3$, —$NH_2$, —SH, and —COOH.

The protective layer 5 preferably contains a cross-linked component obtained by cross-linking a compound having a guanamine structure or a melamine structure, and a specific charge transport material. In addition, the content of the charge transport material in the protective layer 5 is preferably from 90% by weight to 98% by weight, while the content of the fluoro-resin particles is preferably from 2% by weight to 10% by weight.

First, the compound (guanamine compound) having a guanamine structure will be described.

The guanamime compound is a compound having a guanamine skeleton (structure), and examples thereof include acetoguanamine, benzoguanamine, formguanamine, steroguanamine, spiroguanamine, and cyclohexylguanamine.

The guanamine compound is preferably at least one of a compound represented by the following Formula (A) or a polymer thereof. Here, the polymer is an oligomer obtained by polymerizing the compound represented by Formula (A) as a structural unit and has a polymerization degree of, for example, from 2 to 200 (preferably from 2 to 100). In addition, the compound represented by Formula (A) may be used singly or in a combination of two or more kinds thereof.

(A)

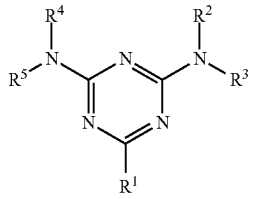

In Formula (A), $R^1$ represents a strain-chain or branched-chain alkyl group having from 1 to 10 carbon atoms, a substituted or unsubstituted phenyl group having from 6 to carbon atoms, or a substituted or unsubstituted alicyclic hydrocarbon group having from 4 to 10 carbon atoms. $R^2$ to $R^5$ each independently represent a hydrogen atom, —$CH_2$—OH or —$CH_2$—O—$R^6$. $R^6$ represents a hydrogen atom or a straight-chain or branched-chain alkyl group having from 1 to 10 carbon atoms.

In Formula (A), the alkyl group represented by $R^1$ has from 1 to 10 carbon atoms, preferably has from 1 to 8 carbon atoms, and more preferably has from 1 to 5 carbon atoms. Additionally, the alkyl group may be either straight-chain or branched-chain.

In Formula (A), the phenyl group represented by $R^1$ has from 6 to 10 carbon atoms and preferably from 6 to 8 carbon atoms. Examples of the substituent on the phenyl group include a methyl group, an ethyl group, and a propyl group.

In Formula (A), the alicyclic hydrocarbon group represented by $R^1$ has from 4 to 10 carbon atoms and preferably from 5 to 8 carbon atoms. Examples of the substituent on the alicyclic hydrocarbon group include a methyl group, an ethyl group, and a propyl group.

In Formula (A), the alkyl group represented by $R^6$ in "—$CH_2$—O—$R^6$" represented by $R^2$ to $R^5$ has from 1 to 10 carbon atoms, preferably from 1 to 8 carbon atoms, and more preferably from 1 to 6 carbon atoms. Additionally, the alkyl group may be either straight-chain or branched-chain. Preferable examples of the alkyl group represented by $R^6$ include a methyl group, an ethyl group, and a butyl group.

The compound represented by Formula (A) is particularly preferably a compound in which $R^1$ represents a substituted or unsubstituted phenyl group having from 6 to 10 carbon atoms, and $R^2$ to $R^5$ each independently represent —$CH_2$—O—$R^6$. Additionally, $R^6$ is preferably selected from a methyl group and an n-butyl group.

The compound represented by Formula (A) is synthesized using, for example, guanamine and formaldehyde by a publicly known method (for example, refer to page 430 of Jikken Kagaku Koza, Fourth edition, Vol. 28).

Next, the compound (melamine compound) having a melamine structure will be described.

The melamine compound is a compound having a melamine skeleton (structure), and is particularly preferably at least one of a compound represented by the following Formula (B) and a polymer thereof. Here, the polymer is an oligomer obtained by polymerizing the compound represented by Formula (B) similarly to Formula (A) as a structural unit and has a polymerization degree of, for example, from 2 to 200 (preferably from 2 to 100). In addition, the compound represented by Formula (B) or a polymer thereof may be used singly or in combination of two or more kinds thereof. Additionally, the compound represented by Formula (B) or a polymer thereof may be used together with the compound represented by Formula (A) or a polymer thereof.

(B)

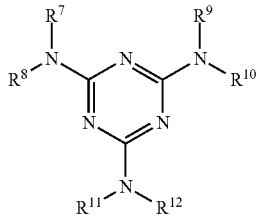

In Formula (B), $R^7$ to $R^{12}$ each independently represent a hydrogen atom, —$CH_2$—OH or —$CH_2$—O—$R^{13}$ wherein $R^{13}$ represents an alkyl group which may be branched-chain having from 1 to carbon atoms. Examples of $R^{13}$ include a methyl group, an ethyl group, and a butyl group.

The compound represented by Formula (B) is synthesized using, for example, melamine and formaldehyde by a publicly known method (for example, synthesized similarly to the melamine resin described on page 430 of Jikken Kagaku Koza, Fourth edition, Vol. 28).

Next, the specific charge transport material will be described.

Preferable examples of the specific charge transport material include at least one substituent selected from —OH, —$OCH_3$, —$NH_2$, —SH, and —COOH (hereinafter simply referred to as "specific reactive functional groups" in some cases). The specific charge transporting material particularly preferably includes at least two or more preferably three substituents selected from the specific reactive functional groups.

The specific charge transport material is preferably a compound represented by the following Formula (I):

$$F—((—R^7—X)_{n1}(R^8)_{n3}—Y)_{n2} \quad (I)$$

In Formula (I), F represents an organic group derived from a compound having a hole transport ability; $R^7$ and $R^8$ each independently represent a straight-chain or branched-chain alkylene group having from 1 to 5 carbon atoms; n1 represents 0 or 1; n2 represents an integer of from 1 to 4; and n3 represents 0 or 1. X represents an oxygen atom, NH, or a sulfur atom; and Y represents —OH, —$OCH_3$, —$NH_2$, —SH, or —COOH (that is, one of the specific reactive functional groups).

In Formula (I), the compound having a hole transport ability in an organic group derived from a compound having a hole transport ability represented by F is preferably an arylamine derivative. Preferable examples of the arylamine derivative include triphenylamine derivatives and tetraphenylbenzidine derivatives.

The compound represented by Formula (I) is preferably a compound represented by the following Formula (II).

(II)

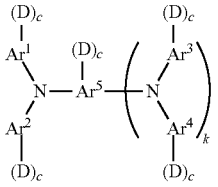

In Formula (II), $Ar^1$ to $Ar^4$ may be the same or different from each other and each independently represent a substituted or unsubstituted aryl group; $Ar^5$ represents a substituted or unsubstituted aryl group or a substituted or unsubstituted arylene group; D represents —(—$R^7$—X)$_{n1}$($R^8$)$_{n3}$—Y; c each independently represents 0 or 1; k represents 0 or 1; the total number of D is from 1 to 4. Additionally, $R^7$ and $R^8$ each independently represent a straight-chain or branched-chain alkylene group having from 1 to 5 carbon atoms; n1 represents 0 or 1; n3 represents 0 or 1; X represents an oxygen atom, NH, or a sulfur atom; and Y represents —OH, —$OCH_3$, —$NH_2$, —SH, or —COOH.

In Formula (II), "—(—$R^7$—X)$_{n1}$($R^8$)$_{n3}$—Y" represented by D is the same as Formula (I), $R^7$ and $R^8$ each independently represent a straight-chain or branched-chain alkylene group having from 1 to 5 carbon atoms. Additionally, n1 is preferably 1. Additionally, X is preferably an oxygen atom. Additionally, Y is preferably a hydroxyl group.

In addition, the total number of D in Formula (II) corresponds to n2 in Formula (I), which is preferably from 2 to 4 and more preferably from 3 to 4. That is, a compound represented by Formula (I) or (II) preferably has the specific reactive functional groups of from 2 to 4 and more preferably from 3 to 4 in one molecule.

In Formula (II), $Ar^1$ to $Ar^4$ are preferably represented by any one of the following formulae (1) to (7). In addition, the following Formulae (1) to (7) are shown with "–(D)$_c$" that may be linked to each of $Ar^1$ to $Ar^4$.

(1)

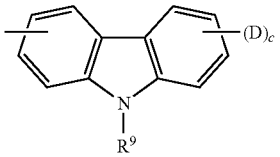

-continued (2)

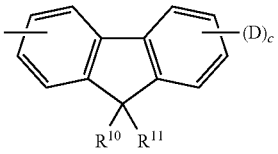

(3)

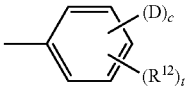

(4)

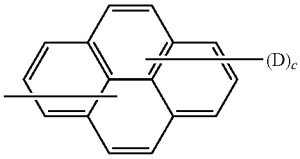

(5)

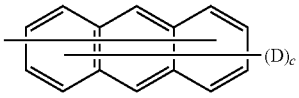

(6)

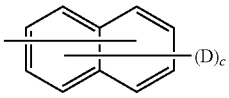

(7)

In Formulae (1) to (7), $R^9$ represents one selected from a group consisting of a hydrogen atom, an alkyl group having from 1 to 4 carbon atoms, a phenyl groups having an alkyl group having from 1 to 4 carbon atoms or an alkoxy group having from 1 to 4 carbon atoms as a substituent thereof, an unsubstituted phenyl group, and an aralkyl group having from 7 to 10 carbon atoms; $R^{10}$ to $R^{12}$ each independently represent one selected from a group consisting of a hydrogen atom, an alkyl group having from 1 to 4 carbon atoms, an alkoxy group having from 1 to 4 carbon atoms, a phenyl group having an alkoxy group having from 1 to 4 carbon atoms as a substituent thereof, an unsubstituted phenyl group, an aralkyl group having from 7 to 10 carbon atoms, and a halogen atom; Ar represents a substituted or unsubstituted arylene group; D and c are the same as "D" and "c" in Formula (II); each s represents 0 or 1; and t represents an integer of from 1 to 3.

In Formula (7), Ar is preferably represented by the following Formula (8) or (9).

(8)

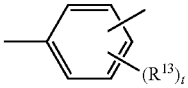

(9)

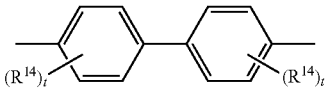

In Formulae (8) and (9), $R^{13}$ and $R^{14}$ each independently represent one selected from a group consisting of a hydrogen atom, an alkyl group having from 1 to 4 carbon atoms, an alkoxy group having from 1 to 4 carbon atoms, a phenyl group having an alkoxy group having from 1 to 4 carbon atoms as a substituent thereof, an unsubstituted phenyl group, an aralkyl group having from 7 to 10 carbon atoms, or a halogen atom; and t represents an integer of from 1 to 3.

Additionally, in Formula (7), Z' preferably represents one represented by the following Formulae (10) to (17).

(10) $-(CH_2)_q-$

(11) $-(CH_2CH_2O)_r-$ (12)

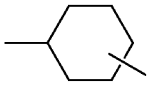

(13)

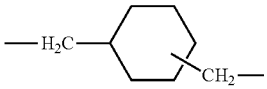

(14)

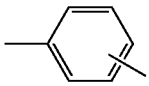

(15)

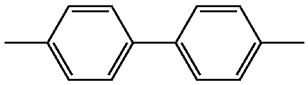

(16)

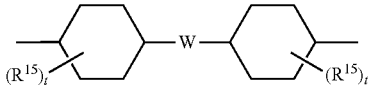

(17)

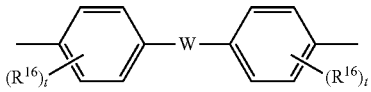

In Formulae (10) to (17), $R^{15}$ and $R^{16}$ each independently represent one selected from a group consisting of a hydrogen atom, an alkyl group having from 1 to 4 carbon atoms, an alkoxy group having from 1 to 4 carbon atoms, a phenyl group having an alkoxy group having from 1 to 4 carbon atoms as a substituent thereof, an unsubstituted phenyl group, an aralkyl group having from 7 to 10 carbon atoms, and a halogen atom; W represents a divalent group; q and r each independently represent an integer of from 1 to 10; and each t represents an integer of from 1 to 3.

In Formulae (16) and (17), W is preferably any one of divalent groups represented by the following Formulae (18) to (26). In Formula (25), u represents an integer of from 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

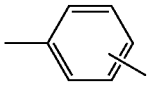

-continued (25)

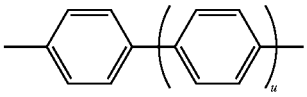

(26)

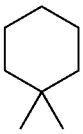

Additionally, in Formula (II), when k is 0, $Ar^5$ preferably corresponds to the aryl group of Formulae (1) to (7) illustrated in the description of $Ar^1$ to $Ar^4$; and when k is 1, $Ar^5$ preferably corresponds to an arylene group obtained by removing a hydrogen atom from the aryl group of Formulae (1) to (7).

(B) Fluoro-Resin Particles

The protective layer 5 preferably contains fluoro-resin particles.

Although the fluoro-resin particles are not particularly limited, one or two or more are preferably selected from among tetrafluoroethylene resin (PTFE), chlorotrifluoroethylene resin, hexafluoropropylene resin, vinyl fluoride resin, vinylidene fluoride resin, dichlorodifluoroethylene resin, and copolymers thereof. Tetrafluoroethylene resin and vinylidene fluoride resin are more preferable, and tetrafluoroethylene resin is particularly preferable.

The average primary particle size of the fluoro-resin particles is preferably from 0.05 μm to 1 μm and more preferably from 0.1 μm to 0.5 μm.

In addition, the average primary particle size of the fluoro-resin particles refers to a value obtained by measuring a measurement liquid diluted in the same solvent as a dispersion liquid having the fluoro-resin particles dispersed therein at a refractive index of 1.35 using a laser diffraction type particle size distribution measuring device LA-920 (made by Horiba, Ltd.).

The content of the fluoro-resin particles to the total solid content of the protective layer 5 is from 2% by weight to 10% by weight.

(C) Other Compositions

Other thermosetting resins such as a phenolic resin, a melamine resin, a urea resin, an alkyd resin, or a benzoguanamine resin together with a cross-linked product in which at least one selected from the guanamine compound and the melamine compound and a specific charge transport material are cross-linked may be used in a mixture for the protective layer 5. Compounds having more functional groups in a molecule such as a spiroacetal guanamine resin (for example, CTU-Guanamine (made by Ajinomoto-Fine-Techno Co., Inc.)) may be copolymerized with the material in the cross-linked product.

Additionally, a surfactant may be added to the protective layer 5. Examples of the surfactant to be used preferably include surfactants having at least one of a fluorine atom, an alkylene oxide structure, and a silicone structure.

An antioxidant may be added to the protective layer 5. Preferable examples of the antioxidants include hindered phenol antioxidants and hindered amine antioxidants, and publicly known antioxidants such as organic sulfur antioxidants, phosphite antioxidants, dithiocarbamate antioxidants, thiourea antioxidants and benzimidazole antioxidants may also be used. The content of the antioxidant is preferably equal to or less than 20% by weight and more preferably equal to or less than 10% by weight.

The protective layer 5 may contain a curing catalyst for promoting curing of the guanamine compound, melamine compound and/or the specific charge transport material. An acidic catalyst is preferable as the curing catalyst. Examples of the acidic catalyst include aliphatic carboxylic acids such as acetic acid, chloroacetic acid, trichloroacetic acid, trifluoroacetic acid, oxalic acid, maleic acid, malonic acid and lactic acid; aromatic carboxylic acids such as benzoic acid, phthalic acid, terephthalic acid and trimellitic acid; and aliphatic or aromatic sulfonic acids such as methanesulfonic acid, dodecylsulfonic acid, benzenesulfonic acid, dodecylbenzenesulfonic acid, and naphthalenesulfonic acid. Among these, sulfur-containing materials are preferable.

The sulfur-containing material used as a curing catalyst is preferably one that shows acidity at normal temperature (for example, at 25° C.) or after heating, and is most preferably at least one of organic sulfonic acids and derivatives thereof. The presence of the catalyst in the protective layer 5 may be easily confirmed by energy dispersive X-ray spectroscopy (EDS), X-ray photoelectron spectroscopy (XPS), or the like.

The blending ratio of the catalyst in the total solid content of a coating liquid excluding the fluoro-resin particles and the fluoro-alkyl group-containing copolymer is preferably within a range of from 0.1% by weight to 10% by weight and particularly preferably from 0.1% by weight to 5% by weight.

Although solvents may be used singly or in a mixture of two or more kinds thereof for the coating liquid for forming the protective layer, the solvent used for forming the protective layer 5 is preferably a cyclic aliphatic ketone compound such as cyclobutanone, cyclopentanone, cyclohexanone, or cycloheptanone. Additionally, examples of the solvent include cyclic or straight-chain alcohols such as methanol, ethanol, propanol, butanol, and cyclopentanol; straight-chain ketones such as acetone and methyl ethyl ketone; cyclic or straight-chain ethers such as tetrahydrofuran, dioxane, ethylene glycol and diethyl ether; and haloganated aliphatic hydrocarbon solvents such as methylene chloride, chloroform, and ethylene chloride, in addition to the cyclic aliphatic ketone compound.

In addition, although the content of the solvent is not particularly limited, the content of the solvent to be used is preferably from 0.5 part by weight to 30 parts by weight, and more preferably from 1 part by weight to 20 parts by weight to 1 part by weight of the guanamine compound and the melamine compound.

The protective layer 5 is obtained by heating and curing (cross-linking) the coating liquid at a temperature of, for example, from 100° C. to 170° C. after the application.

<Process Cartridge and Image Forming Apparatus>

Next, a process cartridge and an image forming apparatus that use the electrophotographic photoreceptor of the present exemplary embodiment will be described.

The process cartridge of the present exemplary embodiment is not particularly limited as long as the process cartridge uses the electrophotographic photoreceptor of the present exemplary embodiment. Specifically, the process cartridge includes the electrophotographic photoreceptor related to the aforementioned present exemplary embodiment that is detachable from an image forming apparatus that transfers a toner image obtained by developing an electrostatic latent image on the surface of a latent image holding member to a recording medium to form an image on the recording medium, and as the latent image holding member, and at least one selected from a charging device, a latent image forming device, a developing device, a transfer device, and a cleaning device.

Additionally, the image forming apparatus of the present exemplary embodiment is not particularly limited as long as the image forming apparatus uses the electrophotographic photoreceptor of the present exemplary embodiment. Specifically, the image forming apparatus preferably includes the electrophotographic photoreceptor related to the present exemplary embodiment, a charging device that charges the electrophotographic photoreceptor, a latent image forming device that forms an electrostatic latent image on the surface of a charged electrophotographic photoreceptor, a developing device that develops the electrostatic latent image formed on the surface of the electrophotographic photoreceptor with a toner to form a toner image, and a transfer device that transfers the toner image formed on the surface of the electrophotographic photoreceptor to a recording medium. In addition, the image forming apparatus of the present exemplary embodiment may be a tandem machine that includes two or more photoreceptors corresponding to toners of different colors. In this case, all the photoreceptors are preferably the electrophotographic photoreceptors of the present exemplary embodiment. Additionally, the transfer of the toner image may be performed through an intermediate transfer system that uses an intermediate transfer member.

Figure 3:
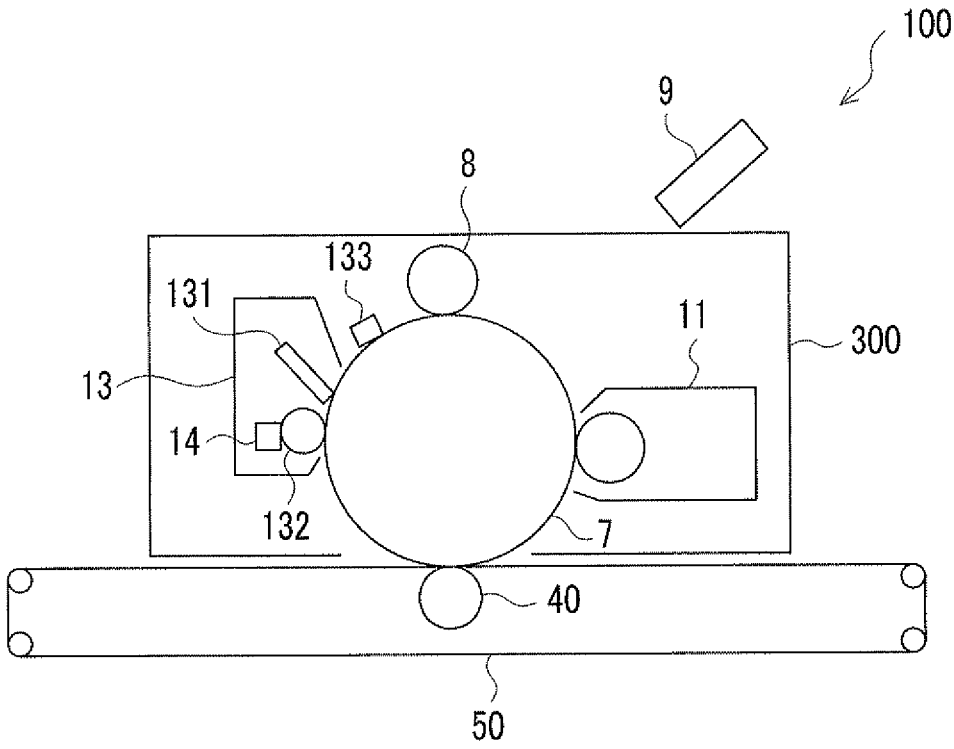
FIG. 3 is a schematic configuration drawing showing an image forming apparatus related to the present exemplary embodiment.

FIG. 3 is a schematic configuration drawing showing the image forming apparatus related to the present exemplary embodiment. As shown in FIG. 3, an image forming apparatus 100 includes a process cartridge 300 equipped with an electrophotographic photoreceptor 7, an exposure device 9 as a latent image forming device, a transfer device 40, and an intermediate transfer member 50. In addition, in the image forming apparatus 100, the exposure device 9 is arranged at a position that allows the exposure device to expose the electrophotographic photoreceptor 7 through an opening of the process cartridge 300. The transfer device 40 is arranged to face the electrophotographic photoreceptor 7 with the intermediate transfer member 50 therebetween. The intermediate transfer member 50 is arranged partly in contact with the electrophotographic photoreceptor 7.

The process cartridge 300 in FIG. 3 integrally supports the electrophotographic photoreceptor 7, a charging device 8, a developing device 11, and a cleaning device 13 in a housing. The cleaning device 13 has a cleaning blade (cleaning member) 131, and the cleaning blade 131 is arranged so as to come into contact with the surface of the electrophotographic photoreceptor 7.

Additionally, although an example is shown in which a fibrous member 132 (roll-shaped) that supplies lubricant 14 onto the surface of the photoreceptor 7 and a fibrous member 133 (flat-brush-shaped) that assists cleaning are used, these components may be used or not used.

An example of the charging device 8 includes a contact-type charger that uses a conductive or semiconductive charging roller, charging brush, charging film, charging rubber blade, charging tube, or the like. Additionally, other publicly known chargers such as non-contact-type roller chargers, scorotron and corotron chargers that utilize corona discharge, and the like may also be used.

In addition, although not shown in the drawing, a photoreceptor heating member for increasing the temperature of the electrophotographic photoreceptor 7 to reduce the relative temperature may be provided around the electrophotographic photoreceptor 7.

An example of the exposure device 9 includes an optical device that exposes the surface of the photoreceptor 7 to light such as semiconductor laser light, LED light, or liquid crystal shutter light to form a certain image. The wavelength of the light source is in the spectral sensitivity region of the photoreceptor. The main wavelength of the semiconductor lasers is near infrared that has an oscillation wavelength near 780 nm. However, the wavelength is not limited thereto. For example, lasers having oscillation wavelengths on the order of 600 nm and blue lasers having oscillation wavelengths near a range of from 400 nm to 450 nm may also be used. Additionally, in order to form color images, it is also effective to use surface-emission laser light sources that output multi-beams.

As the developing device 11, for example, a general developing device that develops images using a magnetic or non-magnetic single-component developer or two-component developer or the like in a contact or non-contact manner may be used. No limitation is imposed on the developing device as long as the functions described above are achieved, and a developing device is selected depending on the purpose. For example, the developing device is a publicly known developing device that causes a single-component developer or a two-component developer to adhere to the photoreceptor 7 using a brush, a roller, or the like. Particularly, a developing device that uses a developing roller having developer carried on the surface thereof is preferably used.

The toner used in the developing device 11 will now be described below.

The toner used in the image forming apparatus of the present exemplary embodiment has an average shape coefficient ($(ML^2/A)\times(\pi/4)\times100$, where ML represents the maximum length of a particle and A represents the projected area of the particle) of preferably from 100 to 150, more preferably from 105 to 145, and most preferably from 110 to 140. Moreover, the toner has a volume-average particle size of preferably from 3 μm to 12 μm and more preferably from 3.5 μm to 9 μm.

The method for producing the toner is not particularly limited. Examples of the method for producing the toner include a kneading and pulverizing method in which a binder resin, a coloring agent, a release agent, a charge-controlling agent, and the like are kneaded, and the mixture is pulverized and classified; a method in which the shape of particles prepared by a kneading and pulverizing method is changed by applying mechanical impact or thermal energy; an emulsion polymerization/aggregation method in which a polymerizable monomer of a binder resin is emulsified and polymerized, the formed dispersion is mixed with a dispersion of a coloring agent, a release agent, a charge-controlling agent, and the like, and the mixture is aggregated and thermally coalesced to obtain toner particles; a suspension polymerization method in which a polymerizable monomer for obtaining a binder resin and a solution of a coloring agent, a release agent, a charge-controlling agent, and the like are suspended in an aqueous solvent to perform polymerization; and a dissolution suspension method in which particles are formed by suspending a binder resin and a solution of a coloring agent, a release agent, a charge-controlling agent, and the like in an aqueous solvent.

Additionally, a publicly known method is also employed in which the toner obtained by the above method is used as a core, the aggregated particles are made to adhere to the toner, and heating and coalescence are performed to provide a core-shell structure. In addition, the toner is preferably produced by a suspension polymerization method, an emulsion polymerization/aggregation method, or a dissolution suspension method that uses an aqueous solvent and more preferably by an emulsion polymerization/aggregation method from viewpoints of the control of the shape and the particle size distribution.

Toner mother particles may contain a binder resin, a coloring agent, and a release agent and may further contain silica and a charge-controlling agent.

Examples of the binder resin used for the toner mother particles include homopolymers and copolymers of styrenes such as styrene and chlorostyrene, monoolefins such as ethylene, propylene, butylene, and isoprene, vinyl esters such as vinyl acetate, vinyl propionate, vinyl benzoate, and vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers such as vinyl methyl ether, vinyl ethyl ether, and vinyl butyl ether, vinyl ketones such as vinyl methyl ketone, vinyl hexyl ketone, and vinyl isopropenyl ketone; and polyester resins obtained by copolymerizing dicarboxylic acids and diols.

Representative examples of the binder resin include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene, and polyester resin. Moreover, representative examples of the binder resin include polyurethane, epoxy resin, silicone resin, polyamide, modified rosin, and paraffin wax.

Additionally, representative examples of the coloring agent include magnetic powder such as magnetite and ferrite, carbon black, aniline blue, Calco Oil Blue, chrome yellow, ultramarine blue, Du Pont oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, and C. I. Pigment Blue 15:3.

Representative examples of the release agent include low-molecular polyethylene, low-molecular polypropylene, Fischer-Tropsch wax, montan wax, carnauba wax, rice wax, and candelilla wax.

Additionally, a publicly known charge-controlling agent is used as the charge-controlling agent. For example, an azo-based metal complex compound, a metal complex compound of salicylic acid, or a resin-type charge-controlling agent having a polar group is used. When the toner is produced by a wet method, a material that is not easily dissolved in water is preferably used. Additionally, the toner may be a magnetic toner that contains a magnetic material or a non-magnetic toner that does not contain a magnetic material.

The toner used in the developing device 11 is produced by mixing the toner mother particles and the external additives using a Henschel mixer, a V blender, or the like. Additionally, when the toner mother particles are produced by a wet method, external additives may be added by a wet method.

Lubricating particles may be added to the toner used in the developing device 11. Examples of the lubricating particles include solid lubricants such as graphite, molybdenum disulfide, talc, fatty acids, and fatty acid metal salts; low-molecular-weight polyolefins such as polypropylene, polyethylene, and polybutene; silicones having a softening point due to heating; aliphatic amides such as amide oleate, amide erucate, amide ricinoleate, and amide stearate; vegetable wax such as carnauba wax, rice wax, candelilla wax, Japan wax, and jojoba oil; animal wax such as beeswax; mineral and petroleum wax such as montan wax, ozokerite, ceresine, paraffin wax, microcrystalline wax, and Fischer-Tropsch wax; and modified products thereof. These lubricating particles may be used singly or in combination of two or more kinds thereof. The average particle size may be within a range of from 0.1 μm to 10 μm. The particles having the above chemical structure may be pulverized to make the particle size uniform. The amount of the lubricating particles added to the toner is preferably within a range of from 0.05% by weight to 2.0% by weight and more preferably from 0.1% by weight to 1.5% by weight.

Inorganic particles, organic particles, and composite particles including inorganic particles attached to the organic particles may be added to the toner used in the developing device 11.

Preferable examples of the inorganic particles include various inorganic oxides, nitrides, and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

Additionally, the inorganic particles described above may be treated with a titanium coupling agent such as tetrabutyl titanate, tetraoctyl titanate, isopropyltriisostearoyl titanate, isopropyltridecylbenzenesulfonyl titanate, and bis(dioctylpyrophosphate)oxyacetate titanate; or a silane coupling agent such as γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane. Additionally, the inorganic particles hydrophobized with a higher fatty acid metal salt such as silicone oil, aluminum stearate, zinc stearate, or calcium stearate are also preferably used.

Examples of the organic particles include styrene resin particles, styrene acrylic resin particles, polyester resin particles, and urethane resin particles.

The number-average particle size of the organic particles is preferably from 5 nm to 1000 nm, more preferably from 5 nm to 800 nm, and most preferably from 5 nm to 700 nm. Additionally, the sum of the added amounts of the above-mentioned particles and lubricating particles is preferably equal to or more than 0.6% by weight.

An inorganic oxide having a small particle size such as a primary particle size of 40 nm or less, is preferably used as another inorganic oxide added to the toner, and an inorganic oxide having a larger particle size is preferably added. Although the inorganic oxide particles are publicly known particles, silica and titanium oxide are preferably used in combination.

Additionally, the inorganic particles having a small particle size may be surface-treated. Moreover, a carbonate such as calcium carbonate or magnesium carbonate or an inorganic mineral such as hydrotalcite are preferably added.

Additionally, the electrophotographic color toner is used by being mixed with a carrier. Examples of the carrier include iron powder, glass beads, ferrite powder, and nickel powder coated or uncoated with a resin. Additionally, the mixing ratio of the carrier is set if needed.

An example of the transfer device 40 is a publicly known transfer charger including a contact-type transfer charger that uses a belt, a roller, a film, or a rubber blade, and a scorotron transfer charger or a corotron transfer charger that utilizes corona discharge.

An example of the intermediate transfer member 50 includes a semiconductive belt (intermediate transfer belt) composed of polyimide, polyamide-imide, polycarbonate, polyarylate, polyester, rubber, or the like. Additionally, the intermediate transfer member 50 may be in the form of a drum instead of a belt.

The image forming apparatus 100 may include an optical erasing device that optically erases the photoreceptor 7, in addition to the above-described devices.

Figure 4:
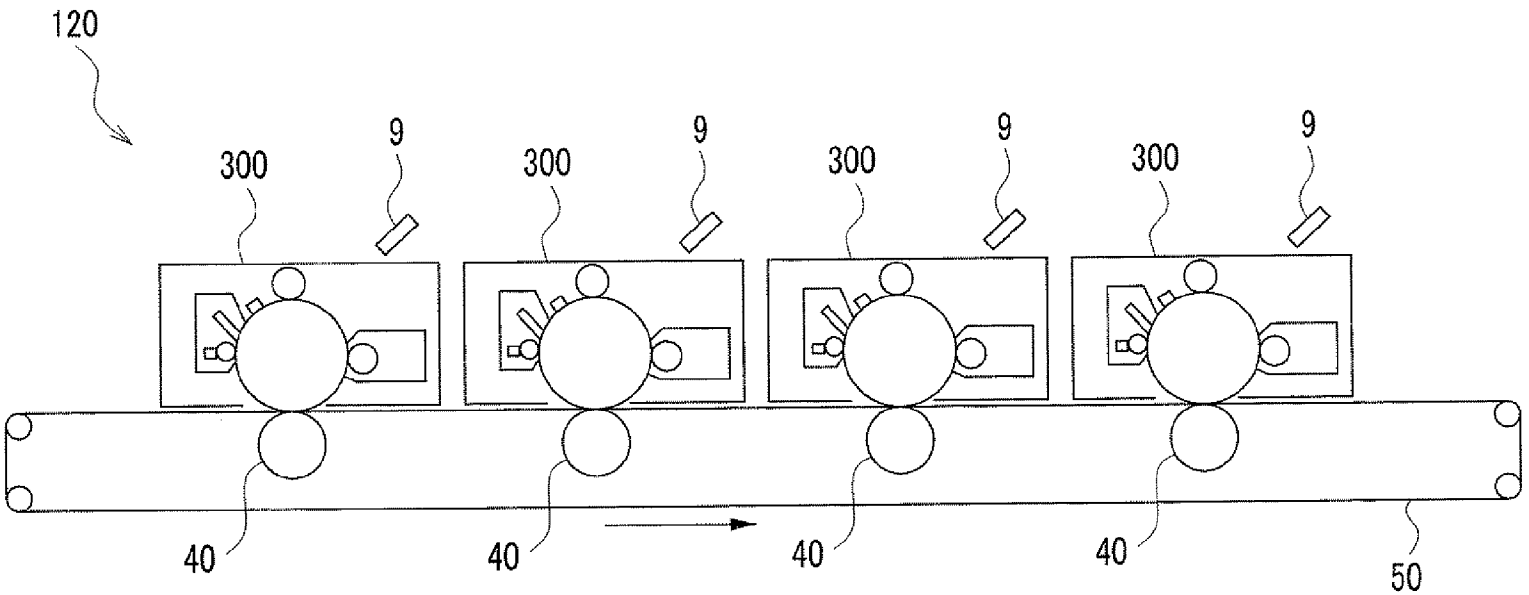
FIG. 4 is a schematic configuration view showing an image forming apparatus related to another exemplary embodiment.

FIG. 4 is a schematic configuration view showing an image forming apparatus related to another exemplary embodiment. As shown in FIG. 4, an image forming apparatus 120 is a tandem multi-color image forming apparatus equipped with four process cartridges 300. The image forming apparatus 120 includes four process cartridges 300 arranged side by side on the intermediate transfer member 50. One electrophotographic photoreceptor is used for one color. In addition, the image forming apparatus 120 has the same configuration as the image forming apparatus 100, except for being a tandem type.

Additionally, in the image forming apparatus (the process cartridge) according to the present exemplary embodiment, the developing device may have a developing roller that is a developer carrier that is moved (rotated) in a direction opposite to the moving direction (rotational direction) of the electrophotographic photoreceptor. Here, the developing roller has a cylindrical developing sleeve that carries a developer on the surface thereof. Additionally, the developing device may have a regulating member for regulating the amount of the developer supplied to the developing sleeve. By moving (rotating) the developing roller of the developing device in a direction opposite to the rotational direction of the electrophotographic photoreceptor, the surface of the electrophotographic photoreceptor is rubbed with the toner remaining between the developing roller and the electrophotographic photoreceptor.

Additionally, in the image forming apparatus of the present exemplary embodiment, the gap between the developing sleeve and the photoreceptor is preferably from 200 μm to 600 μm and more preferably from 300 μm to 500 μm. Additionally, the gap between the developing sleeve and a regulating blade, which is the regulating member for regulating the amount of the developer, is preferably from 300 μm to 1000 μm and more preferably from 400 μm to 750 μm.

Moreover, the absolute value of the moving rate of the surface of the developing roller is preferably from 1.5 times to 2.5 times and more preferably from 1.7 times to 2.0 times the absolute value (process speed) of the moving rate of the surface of the photoreceptor.

Additionally, in the image forming apparatus (process cartridge) according to the present exemplary embodiment, the developing device (developing unit) preferably includes a developer carrier having a magnetic material and preferably develops an electrostatic latent image using a two-component developer containing a magnetic carrier and a toner.

<Image Forming Method>

Next, an image forming method that uses the electrophotographic photoreceptor of the present exemplary embodiment will be described.

The image forming method according to this exemplary embodiment includes a charging process of charging the surface of the electrophotographic photoreceptor according to this exemplary embodiment; a latent image forming process of forming an electrostatic latent image on the surface of the electrophotographic photoreceptor; a developing process of developing the electrostatic latent image formed on the surface of the electrophotographic photoreceptor using developer to form a toner image; and a transfer process of transferring the developed toner image developed to a transfer medium.

EXAMPLES

Although examples of the invention will be specifically described below, the invention is not limited to these examples. In addition, in the following description, all the "parts" means "parts by weight" as long as there is no particular mention.

Example 1

Synthesis of Tin-Zinc Complex Oxide Powder

First, "$ZnSnO_3$" that is the tin-zinc complex oxide powder is synthesized by the following method.

66 parts of sodium stannate trihydrate (made by Wako Pure Chemical Industries, Ltd.) is dissolved in pure water. Additionally, 34 parts of zinc chloride (made by Wako Pure Chemical Industries, Ltd.) is dissolved in a hydrochloric acid aqueous solution, the resulting solution is poured into a liquid in which the sodium stannate trihydrate is dissolved, and the resulting mixture is stirred for 30 minutes at 150 rpm by the three one motor (HEIDON BL600 made by Shinto Scientific Co., Ltd.). Thereafter, water washing and filtering of the sediment are repeated until the conductivity becomes equal to or less than 10 mS/m. Thereafter, drying is performed at 200° C. to obtain Sample 1. The volume average particle size of Sample 1 obtained by this neutralization is 100 nm.

—Measurement of Volume Resistivity—

The volume resistivity of Sample 1 ($ZnSnO_3$) is $2\times10^9$ Ω·cm, $1\times10^9$ Ω·cm, and $3\times10^9$ Ω·cm, and average value is $2\times10^9$ Ω·cm (under 13 MPa) when measurement is made by the aforementioned method, using a powder resistivity measurement unit (MCP-PD51 made by Mitsubishi Chemical Analytech Co., Ltd.).

—X-Ray Diffraction Measurement—

In addition, when X-ray diffraction measurement is performed on Sample 1 using the X-ray diffraction measuring device (D8DISCOVER made by Bruker AXS Ltd.), it is found that the sample is "amorphous".

<Preparation of Photoreceptor>

A photoreceptor in which Sample 1 is internally added to an undercoat layer is produced as follows.

(Formation of Undercoat Layer)

41 parts of Sample 1 that is the tin-zinc complex oxide powder, 12 parts of a curing agent (blocked isocyanate, Sumidur 3175 made by Sumitomo Bayer Urethane Company Ltd.), 6 parts of butyral resin (BM-1 made by Sekisui Chemical Co., Ltd.), 52 parts of methyl ethyl ketone, and 3 parts of silicone resin particles (Tospearl 120 made by Toshiba Silicone Co., Ltd.) are mixed. Further, 100 ppm of silicone oil that becomes a leveling agent (SH29PA made by Dow Corning Toray Silicone Company Ltd) is mixed, and dispersion for 10 hours is performed in a batch-type mill to obtain a liquid for applying an undercoat layer.

This coating liquid is applied on an aluminum base (conductive substrate) with a diameter of 30 mm and a thickness of 1 mm by a dip coating method, and is subjected to drying and curing for 30 minutes at 150° C. to form an undercoat layer with a thickness of 18 μm.

(Formation of Charge Generation Layer)

Next, a photosensitive layer of a two-layer structure is formed on the undercoat layer.

First, a mixture including 15 parts of gallium chloride phthalocyanine as a charge generation material having diffraction peaks at positions where the Bragg angles (2θ±0.2°) of an X-ray diffraction spectrum using Cukα rays are at least 7.4°, 16.6°, 25.5°, and 28.3°, 10 parts of a vinyl chloride-vinyl acetate copolymer resin as a binder resin (VMCH made by Nippon Unicar Company Limited), and 300 parts of butyl acetate is dispersed for 4 hours in a sand mill, using glass beads of 1 mmϕ to obtain a coating liquid for a charge generation layer.

The obtained coating liquid for a charge generation layer is dip-coated on the undercoat layer, and is dried at normal temperature to form a charge generation layer with a thickness of 0.2 μm.

(Formation of Charge Transport Layer)

Moreover, 4 parts of N,N'-diphenyl-N,N'-bis(3-methylphenyl)-[1,1']biphenyl-4,4'-diamine, and 6 parts of bisphenol Z polycarbonate resin (viscosity-average molecular weight 40,000) are added to 80 parts of chlorobenzene, and dissolved to obtain a coating liquid for a charge transport layer.

The obtained coating liquid for a charge transport layer is dip-coated on the charge generation layer, and dried for 40 minutes at 130° C. to form a charge transport layer with a thickness of 25 μm to obtain an electrophotographic photoreceptor.

Example 2

Making Resistance of Tin-Zinc Complex Oxide Powder Low 1

Heat treatment is performed on $ZnSnO_3$ synthesized by the method described in Example 1 for 1 hour at 500° C. under the atmosphere to obtain Sample 2.

—Measurement of Volume Resistivity—

When the volume resistivity of Sample 2 is measured, the volume resistivity is $2\times10^6$ Ω·cm, $1\times10^6$ Ω·cm, and $1\times10^6$ Ω·cm, and average value is $1\times10^6$ Ω·cm.

—X-Ray Diffraction Measurement—

In addition, when X-ray diffraction measurement is performed on Sample 2 using the X-ray diffraction measuring device, it is found that the sample is "amorphous".

A photoreceptor is produced by the method described in Example 1, using Sample 2.

Example 3

Making Resistance of Tin-Zinc Complex Oxide Powder Low 2

Heat treatment is performed on $ZnSnO_3$ synthesized by the method described in Example 1 for 3 hours at 500° C. at 1 kPa under reduced pressure, using an apparatus (trade name: Control Atmosphere Furnace made by Dowa Industrial Co., Ltd.) for performing pressure reduction and heating, to obtain Sample 3.

—Measurement of Volume Resistivity—

When the volume resistivity of Sample 3 is measured, the volume resistivity is $9\times10^2$ Ω·cm and $2\times10^3$ Ω·cm, and average value is $1\times10^3$ Ω·cm.

—X-Ray Diffraction Measurement—

In addition, when X-ray diffraction measurement is performed on Sample 3 using the X-ray diffraction measuring device, it is found that the sample is "amorphous".

A photoreceptor is produced by the method described in Example 1, using Sample 3.

Example 4

Synthesis of Tin-Zinc Complex Oxide Powder and Making Resistance Thereof Low 3

$Zn_2SnO_4$ that is the tin-zinc complex oxide powder is prepared by a chemical synthetic procedure (carbonate method). Specifically, 72 parts of zinc nitrate hexahydrate (made by Wako Pure Chemical Industries, Ltd.) is dissolved in pure water, and 28 parts of tin chloride dihydrate (made by Wako Pure Chemical Industries, Ltd.) is dissolved in a 2M hydrochloric acid aqueous solution, and the resulting solution is mixed in the previous zinc nitrate aqueous solution. 0.5 M/L of a sodium carbonate solution is poured into this solution until pH 7 is obtained, and then stirred for 30 minutes. Sediment is removed by repeating water washing with pure water and filtering until a filtrate becomes equal to or less than 10 mS/m. Thereafter, the resulting product is dried at 200° C., and is heat-treated for 1 hour at 900° C. under the atmosphere.

Thereafter, heat treatment is performed for 1 hour at 900° C. at 1 kPa under reduced pressure, using the apparatus used in Example 3, to obtain Sample 4.

—Measurement of Volume Resistivity—

When the volume resistivity of Sample 4 is measured, the volume resistivity is $4\times10^3$ Ω·cm, $1\times10^3$ Ω·cm, and $1\times10^3$ Ω·cm, and average value is $2\times10^3$ Ω·cm.

—X-Ray Diffraction Measurement—

In addition, when X-ray diffraction measurement is performed on Sample 4 using the X-ray diffraction measuring device, it is found that the sample is a single phase of $Zn_2SnO_4$.

A photoreceptor is produced by the method described in Example 1, using Sample 4.

Example 5

Synthesis of Tin-Zinc Complex Oxide Powder and Making Resistance Thereof Low 4

$ZnSnO_3$ that is the tin-zinc complex oxide powder is prepared using a chemical synthetic procedure (carbonate method). Specifically, 57 parts of zinc nitrate hexahydrate (made by Wako Pure Chemical Industries, Ltd.) is dissolved in pure water, and 43 parts of tin chloride dihydrate (made by Wako Pure Chemical Industries, Ltd.) is dissolved in a 2M hydrochloric acid aqueous solution, and the resulting solution is mixed in the previous zinc nitrate aqueous solution. 0.5 M/L of a sodium carbonate solution is poured into this solution until pH 7 is obtained, and then stirred for 30 minutes. Sediment is removed by repeating water washing with pure water and filtering until a filtrate becomes equal to or less than 10 mS/m. Thereafter, the resulting product is dried at 200° C., and is heat-treated for 1 hour at 500° C. in the atmosphere.

Thereafter, heat treatment is performed for 1 hour at 500° C. at 1 kPa under reduced pressure, using the apparatus used in Example 3, to obtain Sample 5.

—Measurement of Volume Resistivity—

When the volume resistivity of Sample 5 is measured, the volume resistivity is $2\times10^2$ Ω·cm, $3\times10^2$ Ω·cm, and $1\times10^2$ Ω·cm, and average value is $2\times10^2$ Ω·cm (under 13 MPa).

—X-Ray Diffraction Measurement—

In addition, when X-ray diffraction measurement is performed on Sample 5 using the X-ray diffraction measuring device, it is found that the sample is "amorphous".

A photoreceptor is produced by the method described in Example 1, using Sample 5.

Comparative Example 1

A photoreceptor is produced by the method described in Example 1 except that, the particles internally added to the undercoat layer are changed to "zinc oxide (Nanotech ZnO (primary particle size of 30 nm) made by Kasei Co., Ltd.)" from "Sample 1" in Example 1.

Comparative Example 2

A photoreceptor is produced by the method described in Example 1 except that, the particles internally added to the undercoat layer are changed to "titanium oxide (TAF-J500 (primary particle size of 50 nm) made by Fuji Titanium Industry Co., Ltd.)" from "Sample 1" in Example 1.

Comparative Example 3

A photoreceptor is produced by the method described in Example 1 except that, the particles internally added to the undercoat layer are changed to "tin oxide (trade name: S1 (primary particle size of 20 nm) made by Mitsubishi Materials Corp.)" from "Sample 1" in Example 1.

[Evaluation Test]

The electrophotographic photoreceptors produced in the above examples and comparative examples are mounted on a full-color printer Docu Print C620 (made by Fuji Xerox Co., Ltd), and printing tests over continuous 10,000 sheets are performed.

A print quality of images is investigated, the presence of occurrence of fogging is determined visually, and evaluation is made in accordance with the following evaluation criteria.

—Fogging Evaluation—

A: quality of an image in which fogging does not occur is obtained

C: fogging already occurs in an early stage, and severe fogging is observed on an image of a 10,000th sheet Additionally, the presence of occurrence of an image quality defect caused by a leak current is determined visually, and evaluation is made in accordance with the following evaluation criteria.

—Leak Evaluation—

A: an image with no occurrence of an image quality defect caused by a leak current is obtained C: an image in which an image quality defect occurs is obtained

TABLE 1

| | Particles | Volume Resistivity [Ωcm] | Evaluation Fogging | Evaluation Leak |
|---|---|---|---|---|
| Example 1 | $ZnSnO_3$ | $2\times10^9$ | A | A |
| Example 2 | $ZnSnO_3$ | $1\times10^6$ | A | A |
| Example 3 | $ZnSnO_3$ | $1\times10^3$ | A | A |
| Example 4 | $Zn_2SnO_4$ | $2\times10^3$ | A | A |
| Example 5 | $Zn_2SnO_3$ | $2\times10^2$ | A | A |

TABLE 1-continued

| | Particles | Volume Resistivity [Ωcm] | Evaluation Fogging | Evaluation Leak |
|---|---|---|---|---|
| Comparative Example 1 | Zinc oxide | — | C | A |
| Comparative Example 2 | Titanium oxide | — | C | A |
| Comparative Example 3 | Tin oxide | — | A | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a substrate;

an undercoat layer provided on the substrate and containing:

a binder resin, and a tin-zinc complex oxide powder dispersed in the binder resin and having a volume resistivity of about $2\times10^9$ Ω·cm or less, wherein the tin-zinc complex oxide powder is an amorphous material; and a photosensitive layer provided on the undercoat layer.

2. The electrophotographic photoreceptor according to claim 1, wherein the tin-zinc complex oxide powder is a powder heat-treated at a temperature of from about 450° C. to about 900° C. under reduced pressure.

3. The electrophotographic photoreceptor according to claim 2, wherein the degree of vacuum in the heat treatment is from about 10 Pa to about 3 kPa.

4. The electrophotographic photoreceptor according to claim 1, wherein the volume average particle size of the tin-zinc complex oxide powder is within a range of from about 20 nm to about 200 nm.

5. The electrophotographic photoreceptor according to claim 1, wherein the tin-zinc complex oxide powder is contained in the undercoat layer within a range of from about 10% by weight to about 95% by weight.

6. The electrophotographic photoreceptor according to claim 1, wherein the tin-zinc complex oxide powder has a volume resistivity of from about $1\times10^6$ Ω·cm or less.

7. The electrophotographic photoreceptor according to claim 1, wherein the tin-zinc complex oxide powder is $ZnSnO_3$ or $Zn_2SnO_4$.

8. A process cartridge for an image forming apparatus comprising:

the electrophotographic photoreceptor according to claim 1; and at least one device selected from a charging device that charges the electrophotographic photoreceptor, a latent image forming device that forms an electrostatic latent image on the surface of a charged electrophotographic photoreceptor, a developing device that develops the electrostatic latent image formed on the surface of the electrophotographic photoreceptor with a toner to form a toner image, a transfer device that transfers the toner image formed on the surface of the electrophotographic photoreceptor to a recording medium, and a cleaning device that cleans the surface of the electrophotographic photoreceptor.

9. The process cartridge for an image forming apparatus according to claim 8, wherein the tin-zinc complex oxide powder of the electrophotographic photoreceptor has a volume average particle size within a range of from about 20 nm to about 200 nm.

10. An image forming apparatus comprising:

the electrophotographic photoreceptor according to claim 1;

a charging device that charges the electrophotographic photoreceptor;

a latent image forming device that forms an electrostatic latent image on the surface of a charged electrophotographic photoreceptor;

a developing device that develops the electrostatic latent image formed on the surface of the electrophotographic photoreceptor with a toner to form a toner image; and a transfer device that transfers the toner image formed on the surface of the electrophotographic photoreceptor to a recording medium.

11. The image forming apparatus according to claim 10, wherein the tin-zinc complex oxide powder of the electrophotographic photoreceptor is an amorphous material.

12. The image forming apparatus according to claim 10, wherein the tin-zinc complex oxide powder of the electrophotographic photoreceptor has a volume average particle size within a range of from about 20 nm to about 200 nm.

13. An image forming method comprising:

charging the surface of an electrophotographic photoreceptor;

forming an electrostatic latent image on the surface of the electrophotographic photoreceptor;

developing the electrostatic latent image formed on the surface of the electrophotographic photoreceptor using developer to form a toner image; and transferring the developed toner image developed to a transfer medium, wherein the electrophotographic photoreceptor is the electrophotographic photoreceptor according to claim 1.

14. The image forming method according to claim 13, wherein the tin-zinc complex oxide powder of the electrophotographic photoreceptor has a volume average particle size within a range of from about 20 nm to about 200 nm.

* * * * *